US009666353B2

(12) United States Patent
Moiseev

(10) Patent No.: US 9,666,353 B2
(45) Date of Patent: May 30, 2017

(54) INDUCTION DEVICE

(71) Applicant: KABUSHIKI KAISHA TOYOTA JIDOSHOKKI, Aichi-ken (JP)

(72) Inventor: Sergey Moiseev, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 0 days.

(21) Appl. No.: 14/678,423

(22) Filed: Apr. 3, 2015

(65) Prior Publication Data

US 2015/0294782 A1 Oct. 15, 2015

(30) Foreign Application Priority Data

Apr. 10, 2014 (JP) ..... 2014-081295

(51) Int. Cl.

| | |
|---|---|
| ***H01F 27/08*** | (2006.01) |
| ***H01F 27/28*** | (2006.01) |
| ***H01F 27/30*** | (2006.01) |
| ***H01F 27/22*** | (2006.01) |

(52) U.S. Cl.

CPC ..... *H01F 27/2866* (2013.01); *H01F 27/22* (2013.01)

(58) Field of Classification Search

CPC ..... H01F 27/2866; H01F 27/22; H01F 27/02; H01F 27/2823; H01F 27/2847

USPC ..... 336/221, 61, 206, 232, 220

See application file for complete search history.

(56) References Cited

U.S. PATENT DOCUMENTS 5,408,209 A * 4/1995 Tanzer ..... F28D 15/0233 320/108
5,684,445 A * 11/1997 Kobayashi ..... H01F 27/2866 336/206
6,522,233 B1 * 2/2003 Kyoso ..... H01F 27/324 336/192

(Continued)

FOREIGN PATENT DOCUMENTS

JP H04-20217 2/1992
JP 2003-079150 3/2003

(Continued)

OTHER PUBLICATIONS

Office Action issued in Japan Patent Appl. No. JP 2014-081295 dated Apr. 19, 2016, along with an English translation thereof.

(Continued)

*Primary Examiner* — Mangtin Lian
(74) *Attorney, Agent, or Firm* — Greenblum & Bernstein, P.L.C.

(57) ABSTRACT

There is provided an induction device including a first coil formed by winding a plurality of times a conductive wire that is covered with an insulating layer, a second coil formed of a metal pattern, and a coil support member disposed between the first coil and the second coil. The first coil and the second coil are magnetically connected to each other. There is also provided a transformer including a primary coil formed by winding a plurality of times a conductive wire that is covered with an insulating layer, a secondary coil formed of a metal pattern, and an insulating sheet that is disposed between the primary coil and the secondary coil. The primary coil and the secondary coil are magnetically connected to each other.

7 Claims, 4 Drawing Sheets

(56) References Cited

U.S. PATENT DOCUMENTS

| | | | | |
|---|---|---|---|---|
| 6,859,130 | B2 * | 2/2005 | Nakashima | H01F 27/2804 29/602.1 |
| 2002/0159214 | A1 * | 10/2002 | Perlick | H01F 27/06 361/160 |
| 2004/0032313 | A1 * | 2/2004 | Ferencz | H01F 27/266 336/200 |
| 2007/0273465 | A1 * | 11/2007 | Feng | H01F 27/2866 336/212 |
| 2012/0161911 | A1 * | 6/2012 | Moiseev | H01F 27/2804 336/55 |

FOREIGN PATENT DOCUMENTS

| | | |
|---|---|---|
| JP | 2008252035 | 10/2008 |
| JP | 2010-153724 | 7/2010 |
| JP | 2013-062355 | 4/2013 |

OTHER PUBLICATIONS

Office Action issued in Japan Patent Application No. JP 2014-081295 dated Dec. 13, 2016.

* cited by examiner

INDUCTION DEVICE

BACKGROUND OF THE INVENTION

The present invention relates to an induction device and, specifically, to an induction device that operates on electromagnetic induction and is suitable for use, for example, as a transformer of an insulated power converter.

In an insulated power converter, electric power is converted by a transformer. Japanese Patent Application Publication 2010-153724 discloses a switching power supply device that is one of insulated power converters. The switching power supply device has a coil substrate structure formed by including a first coil substrate having a primary transformer coil part and a second coil substrate disposed overlapping the first coil substrate and having a secondary transformer part. In the coil substrate structure, the primary and secondary transformer coil parts include spirally extending conductor patterns, respectively as seen in the thickness direction of the substrate. The first and second coil substrates are disposed one on the other in such an overlapping relation that the primary and secondary transformer coil parts coincide each other as seen in the substrate thickness direction.

A hybrid vehicle has been put into practical use, whose drive wheels are driven by a motor at a start and in a low speed range and by an internal combustion engine in intermediate and high speed ranges to reduce fuel consumption and exhaust gas emission. Such a hybrid vehicle has a main battery supplying power with a voltage of 200 to 300 volts to a traction motor. However, the voltage of 200 to 300 volts needs to be stepped down to 12 volts to drive electric auxiliary equipment of a vehicle whose rated voltage is usually 12 volts.

When the numbers of turns of primary and secondary coils of a transformer are represented by N1, N2, respectively, and the voltages of the primary and secondary coils of the transformer by V1, V2, respectively, N1/N2=V1/V2 is true if all magnetic flux from the primary coil passes through the secondary coil. Furthermore, N1/N2=k*(V1/V2) is true if a rate k of all magnetic flux from the primary coil passes through the secondary coil. The rate k is called coupling coefficient between the primary and secondary coils. The rate k has a value of 1 or less. If all magnetic flux from the primary coil passes through the secondary coil with no leakage of the magnetic flux, the rate k is 1. Therefore, in stepping down the voltage of 200 to 300 volts to 12 volts, through depending on the value of rate k, the number of turns of the primary coil need be 10 times or more than that of the secondary coil.

There is a limit to the spaced distance between any two adjacent turns of coil that is made by using a method such as pressing or etching. Increasing the number of turns of the coil causes the coil to be enlarged in the radial direction thereof. On the other hand, there has been a demand for increasing the number of turns of the coil without enlargement in size to meet the increasing consumption of power.

The present invention, which is made in view of the above problems, is directed to an induction device that can increase the number of turns of coil without enlargement in size.

SUMMARY OF THE INVENTION

There is provided an induction device including a first coil formed by winding a plurality of times a conductive wire that is covered with an insulating layer, a second coil formed of a metal pattern, and a coil support member disposed between the first coil and the second coil. The first coil and the second coil are magnetically connected to each other. There is also provided a transformer including a primary coil formed by winding a plurality of times a conductive wire that is covered with an insulating layer, a secondary coil formed of a metal pattern, and an insulating sheet that is disposed between the primary coil and the secondary coil. The primary coil and the secondary coil are magnetically connected to each other.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

Figure 1:
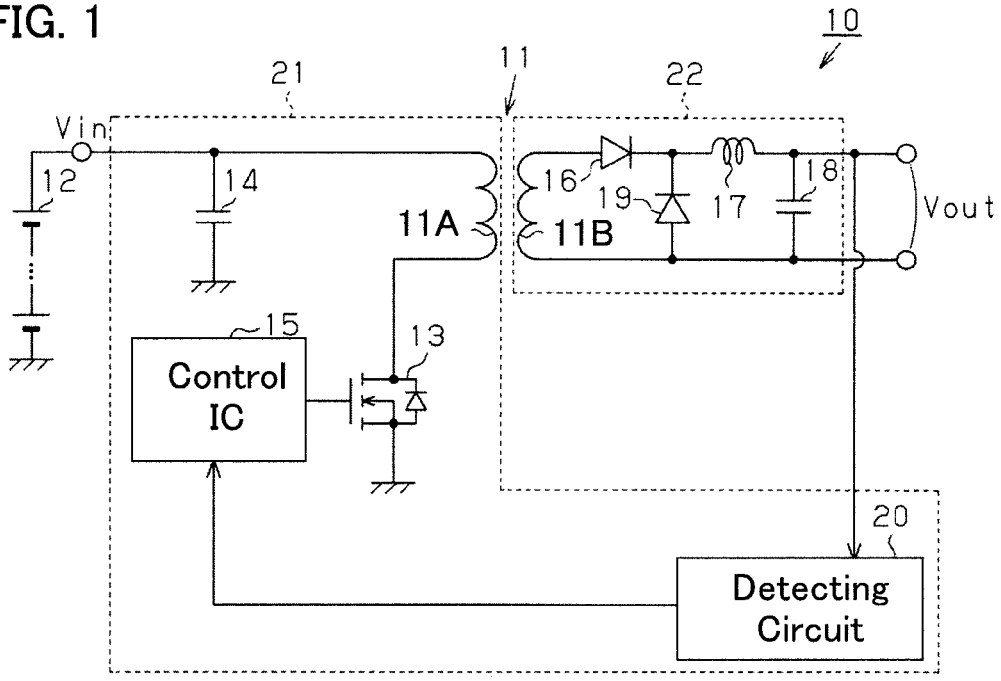
FIG. 1 is a circuit diagram showing an electrical configuration of an insulated DC-DC converter according to an embodiment of the present invention.

The following will describe a transformer of an insulated DC-DC converter according to an embodiment of the present invention with reference to the accompanying drawings. Referring to FIG. 1, the insulated DC-DC converter is of a forward type and designated generally by reference numeral 10. The insulated DC-DC converter has a transformer 11 that includes a primary coil 11A as a first coil and a secondary coil 11B as a second coil. The insulated DC-DC converter 10 is used for a vehicle and mounted, for example, on a hybrid vehicle. The insulated DC-DC converter 10 steps down, for example 300 volts to 12 volts.

One terminal of the primary coil 11A is connected to the input terminal of the insulated DC-DC converter 10 which is in turn connected to the positive terminal of a battery 12. The other terminal of the primary coil 11A is grounded through a switching element 13 of a primary circuit. A power MOSFET is used for the switching element 13.

A smoothing capacitor 14 is connected at the positive electrode thereof to the junction between the input terminal and the primary coil 11A of the transformer 11. The negative electrode of the smoothing capacitor 14 is grounded. An electrolytic capacitor is used for the smoothing capacitor 14. The input voltage of the primary circuit to the transformer 11 is smoothed by the smoothing capacitor 14.

One end of the secondary coil 11B of the transformer 11 is connected to the output terminal of the insulated DC-DC converter through a series circuit including a diode 16 and a coil 17. The anode and the cathode electrodes of the diode 16 are connected to the one end of the secondary coil 11B of the transformer 11 and the output terminal through the coil 17, respectively. The other end of the secondary coil 11B of the transformer 11 is connected to the output terminal of the insulated DC-DC converter. A capacitor 18 is connected to the junction between the coil 17 and the output terminal and the junction between the other end of the secondary coil 11B of the transformer 11 and the output terminal. A diode 19 is connected to the junction between the other end of the secondary coil 11B of the transformer 11 and the cathode of the diode 16. The anode electrode and the cathode electrodes of the diode 19 are connected to the other end of the secondary coil 11B of the transformer 11 and the cathode electrode of the diode 16, respectively.

A control IC 15 is connected to the gate terminal of the switching element 13. The control IC 15 transmits a pulse signal to the gate terminal of the switching element 13. The switching of the switching element 13 is controlled by the pulse signal. When the switching element 13 is on, the input voltage of the primary circuit is supplied to a secondary circuit. When the switching element 13 is off, the electrical power accumulated in the coil 17 is output. Specifically, direct voltage is supplied to the primary coil 11A of the transformer 11 through the smoothing capacitor 14 and the switching element 13 is on-off controlled by the control IC 15, with the result that primary current flows in the primary coil 11A during the on-time of the switching element 13 and secondary current flows by electromotive force of the transformer 11, accordingly. When the switching element 13 is off, the current of the coil 17 is flown through the diode 19 to the output terminal by back electromotive force of the coil 17.

A detecting circuit 20 is connected to the control IC 15 and measures the output voltage Vout. A detection signal indicative of the measured output voltage Vout is transmitted to the control IC 15 by the detecting circuit 20. The control IC 15 controls switching duties of the switching element 13 by using the measured result of the output voltage Vout as data for feedback control so that the output voltage Vout is changed to a desired constant value.

Numeral 21 designates a first substrate that includes the primary coil 11A of the transformer 11, the switching element 13, the smoothing capacitor 14, the control IC 14, and the detecting circuit 20. Numeral 22 designates a second substrate that includes the secondary coil 11B of the transformer 11, the diodes 16, 19, the coil 17, and the capacitor 18.

Figure 2:
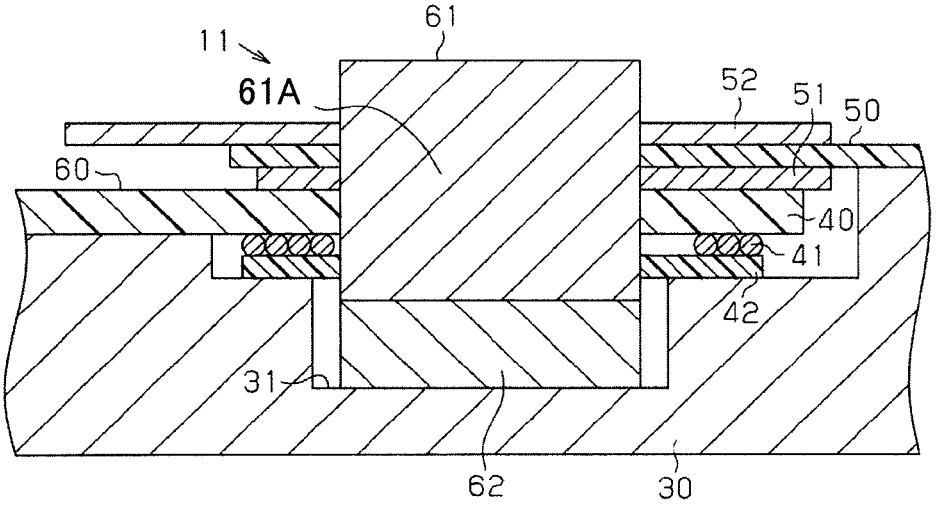
FIG. 2 is a schematic sectional view of a transformer of the insulated DC-DC converter of FIG. 1 and its related parts.
Figure 3:
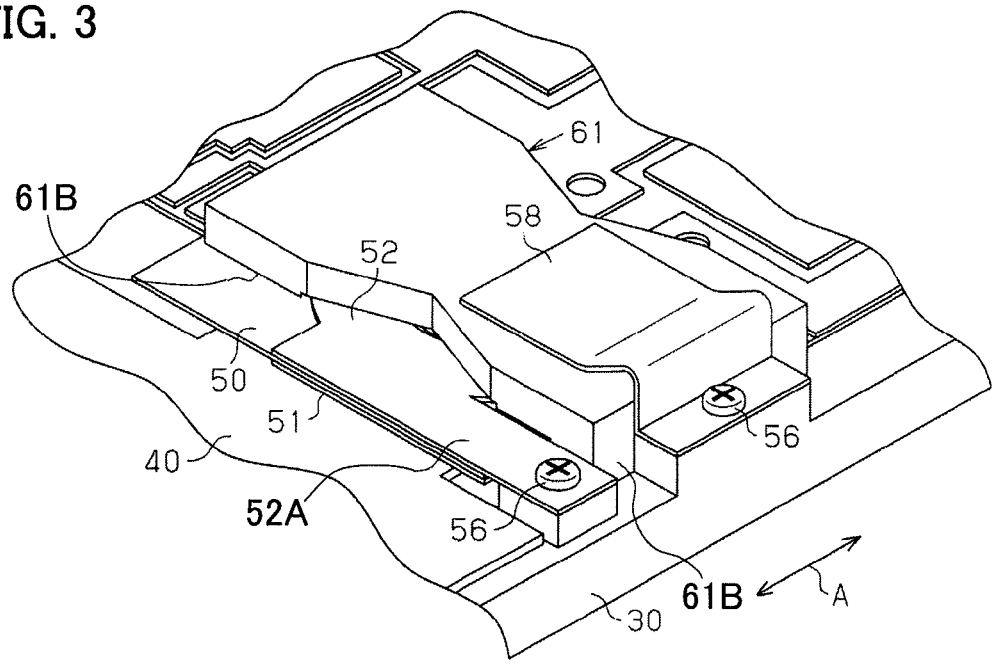
FIG. 3 is a perspective view showing the transformer of FIG. 2 and its related parts.

The following will describe the structure of the transformer 11 and its related parts. As shown in FIGS. 2 and 3, the transformer 11 is disposed in an aluminum case 30 and has a primary coil 41 as a first coil, a secondary coil 51 as a second coil, and a coil support 60 disposed between the primary and secondary coils 41, 51. The primary and secondary coils 41, 51 correspond to the primary and secondary coils 11A, 11B of FIG. 1, respectively. It is noted that FIG. 2 is a schematic sectional view taken along an imaginary plane extending in the longitudinal direction (arrow direction A of FIG. 3) and the thickness direction of the aluminum case 30. In FIG. 2, the wire diameter of the primary coil 41 is shown larger than actual wire diameter and the number of turns of the primary coil 41 smaller than actual than actual number of turns for the sake of illustration. The aluminum case 30 serves also as heat sink and grounding.

Specifically, the primary coil 41 is mounted on a first substrate 40 that is supported by an insulating substrate in which a primary circuit is formed. The secondary coil 51 is supported on a second substrate 50 that is formed by an insulating substrate in which a secondary circuit is formed. The first substrate 40 is disposed at a position adjacent to the aluminum case 30 and the second substrate 50 is disposed above the first substrate 40. The primary coil 41 is supported by the first substrate 40 on the side thereof that is opposite from the second substrate 50. The first substrate 40 has an opening in radially inside of the primary coil 41, through which a core of the transformer 11 is provided.

An insulating sheet 42 is provided between the primary coil 41 of the first substrate 40 and the aluminum case 30. The first substrate 40 is fixed to the aluminum case 30 in contact therewith except the portion thereof on which the primary coil 41 is mounted. The insulating sheet 42 serves also as heat sink and pressure absorption as well as the insulator. The secondary coil 51 of the second substrate 50 is disposed at a position adjacent to the first substrate 40. The second substrate 50 is fixed to the aluminum case 30 in contact therewith except the portion thereof on which the secondary coil 51 is supported. The first substrate 40 also serves as the coil support 60. A radiator plate 52 is provided to the second substrate 50 on the surface thereof that is opposite from the secondary coil 51 and can be fixed to the aluminum case 30 as the heat sink member.

Specifically, the first coil (or the primary coil 41) is provided on the first insulating substrate (or the first substrate 40) and the second coil (or the secondary coil 51) is provided on the second insulating substrate (or the second substrate 50). The radiator plate 52 is provided on the side of the second insulating substrate that is opposite from the second coil and can be fixed to a grounding member serving also as the heat sink member. The first coil and the second coil are disposed on the opposite sides of the first insulating substrate. The first coil, the second coil, and the radiator plate 52 are disposed in overlapping relation to each other.

The transformer 11 further has an upper core 61 and a lower core 62. The upper core 61 has a center magnetic leg portion 61A and side magnetic leg portions 61B (FIG. 3). The center magnetic leg portion 61A of the upper core 61 is inserted through holes or openings that are formed through the radiator plate 52, the secondary coil 51, the second substrate 50, the first substrate 40, the primary coil 41, and the insulating sheet 42. The side magnetic leg portions 61B are formed on the opposite sides of the center magnetic leg portions 61A as seen in the direction across the longitudinal direction A (FIG. 3) of the aluminum case 30. The lower core 62 has an I-shape with flat surfaces. As shown in FIG. 2, the lower core 62 is disposed in an accommodating space 31 formed in the aluminum case 30. The upper core 61 is disposed with the center magnetic leg portion 61A and the side magnetic leg portions 61B thereof set in contact with the lower core 62.

That is, the first substrate 40 serves as the coil support 60 disposed between the first coil (or the primary coil 41) and the second coil (or the secondary coil 51). The primary coil 41, the secondary coil 51, and the coil support 60 cooperate to form an induction device. The primary coil 41 and the secondary coil 51 are magnetically connected.

Figure 4:
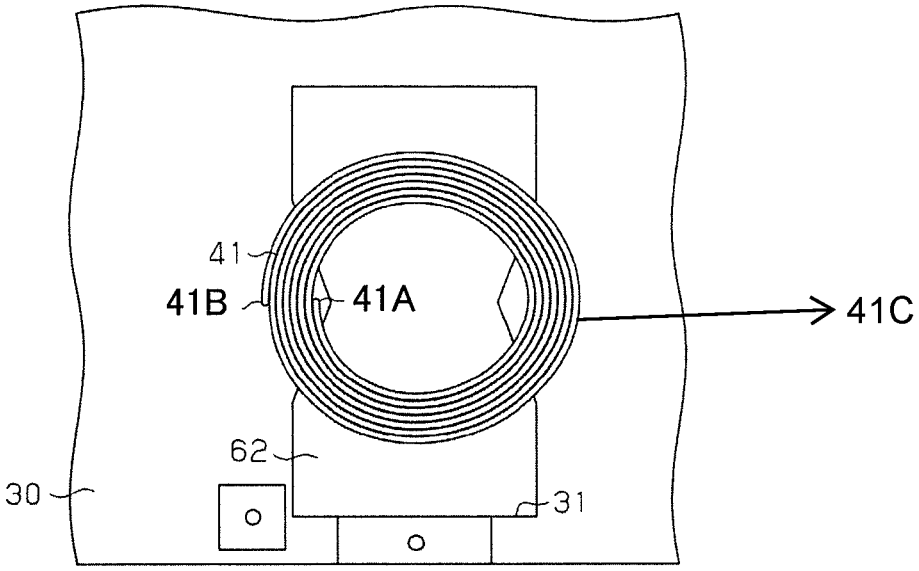
FIG. 4 is a schematic plan view showing the arrangement of a primary coil of the transformer of FIG. 2.

The primary coil 41 is formed by winding a plurality of times a conductive wire that is covered with an insulating layer 41C. An enameled wire is used for the conductive wire. Though depending on the wire diameter, the thickness of the insulating layer 41C of the enameled wire ranges from 40 to 100 micrometers. As shown FIGS. 2 and 4, the primary coil 41 is spirally wound in a single layer. FIG. 4 omits the illustration of the first substrate 40, the secondary coil 51, the second substrate 50, the radiator plate 52, and the upper core 61 that are disposed above the primary coil 41 for the sake of clarity of the shape and disposition of the primary coil 41.

Figure 5A:
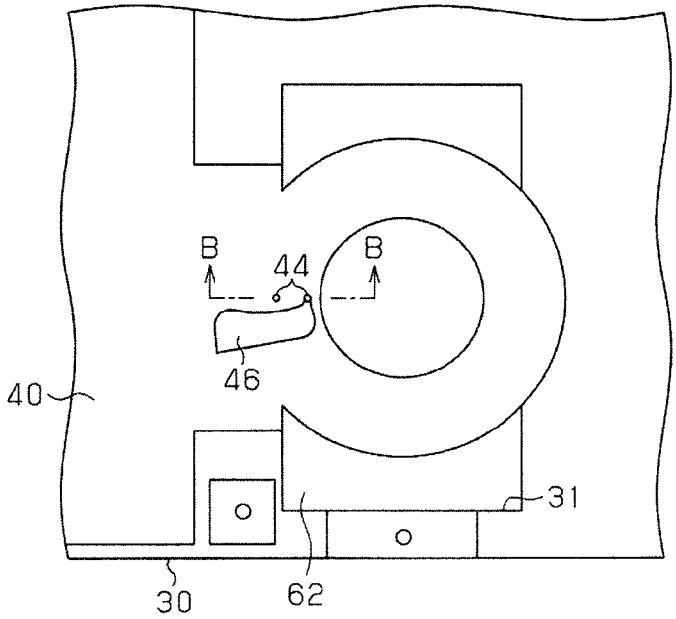
FIG. 5A is a schematic plan view showing the arrangement of a primary substrate of the insulated DC-DC converter of FIG. 1.
Figure 5B:
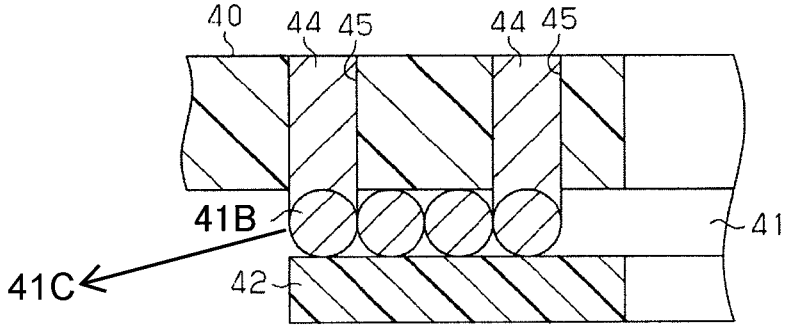
FIG. 5B is a schematic sectional view taken along the B-B line of FIG. 5A.

As shown in FIGS. 5A and 5B, a winding start 41A and a winding end 41B of the primary coil 41 are connected to the first substrate 40 by a solder 44, respectively. The winding start means an end of the coil that is located at the radially inward end of the primary coil 41. The winding end coil means an end of the coil that is located at radially outward end of the primary coil 41. In FIG. 5A, the illustration of the secondary coil 51, the second substrate 50, the radiator plate 52, and the upper core 61 that are disposed above the first substrate 40 is omitted for the sake of clarity of the shape of the first substrate 40. As shown in FIG. 5A, the portion of the first substrate 40 that faces the primary coil 41 is formed substantially annular. As shown in FIG. 5B, the first substrate 40 has through holes 45 that are formed at positions facing the winding start 41A and the winding end 41B of the primary coil 41 and filled with the solder 44, respectively. The winding start 41A and the winding end 41B of the primary coil 41 are connected to the patterns on the first substrate 40 through the solder 44, respectively. The winding start 41A that is located at the radially inward of the primary coil 41 is connected to a substrate pattern 46 that is formed on the face side of the first substrate 40. The substrate pattern 46 extends to the outside of the primary coil 41. The face side of the first substrate 40 means the surface of the first substrate 40 on the side thereof on which electronic parts (not shown) are mounted. The primary coil 41 is supported by the first substrate 40 not only at the winding start 41A and the winding end 41B, but the primary coil 41 is also fixed to the first substrate 40 at an intermediate portion thereof by adhesive.

Figure 6:
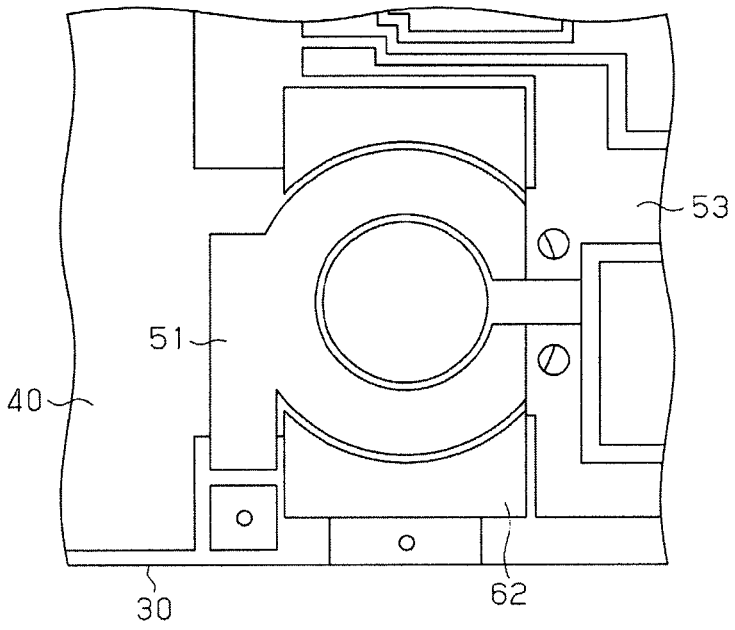
FIG. 6 is a schematic plan view showing the arrangement of a secondary coil of the transformer of FIG. 2.

As shown FIG. 6, the secondary coil 51 is formed of a metal pattern. In the embodiment, the secondary coil 51 is formed by punching a copper plate. In FIG. 6, the illustration of the second substrate 50 and the radiator plate 52 that are disposed above the secondary coil 51 is omitted for the sake of clarity of the secondary coil 51. As shown in FIG. 6, the secondary coil 51 that is wound in a single turn has a substantially C-shape and is connected at the opposite ends thereof to a secondary circuit 53. The secondary coil 51 is fixed to the second substrate 50 at an intermediate portion thereof by adhesive. An insulating sheet (not shown) is disposed between the first substrate 40 and the secondary coil 51.

Figure 7:
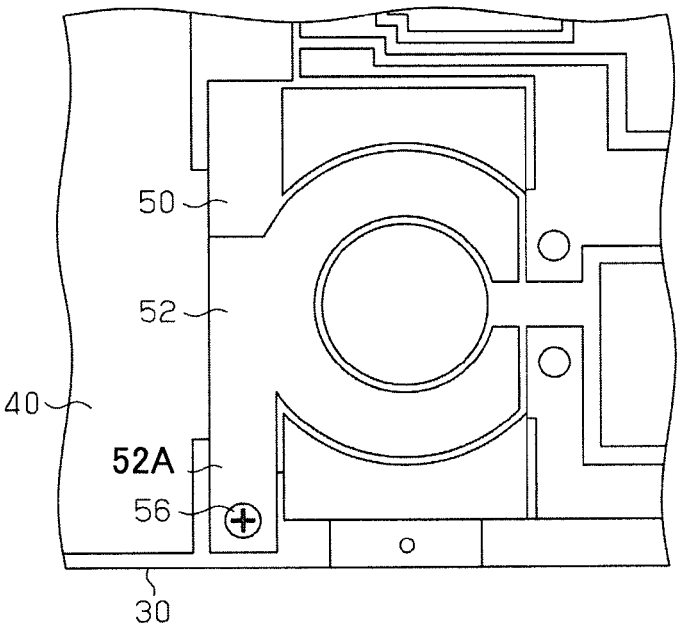
FIG. 7 is a schematic plan view showing the arrangement of a secondary substrate of the insulated DC-DC converter of FIG. 1.

As shown FIG. 7, the radiator plate 52 that is disposed on the side of the second substrate 50 that is opposite from the secondary coil 51, as shown in FIG. 2 is formed of a metal pattern having the substantially the same shape as the secondary coil 51. The radiator plate 52 has a straight portion 52A extending in a tangential relation to the C-shaped secondary coil 51 and is fixed to the aluminum case 30 at the straight portion 52A by a screw 56.

As shown in FIG. 3, the upper core 61 is disposed straddling the radiator plate 52 and pressed against the aluminum case 30 by the metal pressing plate 58 that is fixed to the aluminum case 30 by the screw 56.

The following will describe a process for making the insulated DC-DC converter 11. The enameled wire for the primary coil 41 is wound by means of a core bar which is used for winding the enameled wire in the desired numbers of turns in a substantially planar spiral shape and a jig having a pair of guide plates which are disposed perpendicularly to the core bar at a spaced distance that is slightly larger than the diameter of the enameled wire and between which the enameled wire is supported. The outer diameter of the core bar is the substantially same as the inner diameter of the primary coil 41. After the enameled wire has been wound for desired number of turns, the guide plates are removed and then the core bar is removed from the spiral wound enameled wire, with the result that the primary coil 41 is formed.

After the primary coil 41 is fixed at a portion thereof to the first substrate 40 at a predetermined position thereof by adhesive, the winding start 41A is connected through the substrate pattern 46 to the primary circuit (not shown) by the solder 44 and the winding end 41B is connected to the primary circuit by the solder 44. Thus, the primary coil 41 is connected to the primary circuit of the first substrate 40 without using any terminal or connector.

After the secondary coil 51 is fixed at a portion thereof to the second substrate 50 at a predetermined position thereof by adhesive, the secondary coil 51 is mounted on the second substrate 50 with the opposite ends of the secondary coil 51 connected to the secondary circuit 53 by soldering. With the first substrate 40 on which the primary coil 41 is mounted and the second substrate 50 on which the secondary coil 51 is mounted prepared, the lower core 62 is disposed at a predetermined position in the accommodating space 31 of the aluminum case 30 with the opposite longitudinal ends of the lower core 62 set in contact with the accommodating space 31.

Next, with the insulating sheet 42 disposed at a predetermined position around the accommodating space 31, the primary coil 41 of the first substrate 40 is placed straddling the lower core 62 and the first substrate 40 is fixed to the aluminum case 30 by a screw (not shown).

After the insulating sheet 42 is disposed covering at least such parts as the solder 44 and the through hole 45 of the first substrate 40, and a portion of the substrate pattern 46 facing the secondary coil 51, the second substrate 50 is disposed at a predetermined position in which the secondary coil 51 faces the first substrate 40 and fixed to the aluminum case 30 by a screw.

Next, the radiator plate 52 is disposed above the second substrate 50 and fixed to the aluminum case 30 by the screw 56, thus the configuration shown in FIG. 7 being completed. Then, the upper core 61 is disposed so that its center magnetic leg portion 61A and the side magnetic leg portions 61B set in contact with the upper surface of the lower core 62. The metal pressing plate 58 is set above the upper core 61 and fixed to the aluminum case 30 by the screw 56 so that the upper core 61 and the lower core 62 are pressed and fixed to the aluminum case 30.

Thus, the transformer and its related parts in the insulated DC-DC converter are assembled.

The following will describe the operation of the transformer 11. As the switching element 13 of the primary circuit performs switching operation, the voltage of the battery 12 is applied across the primary coil 41 of the transformer 11 and current flows in the primary coil 41. The voltage is stepped down at the secondary coil 51 according to the coil ratio between the primary and secondary coils 41, 51 and current is flown in the secondary coil 51, accordingly. The primary coil 41 and the secondary coil 51 are heated by the current flowing in the coils. The heat of the primary coil 41 is transmitted through the insulating sheet 42 to the aluminum case 30 and radiated to the atmosphere. The heat of the secondary coil 51 is transmitted through the second substrate 50 to the radiator plate 52, from which the heat is transmitted to the aluminum case 30 and radiated to the atmosphere.

The primary coil 41 and the secondary coil 51 are electrically insulated by the first substrate 40 serving as the insulating substrate. A space for fixing the primary coil 41 and the secondary coil 51 is secured by the insulating substrate forming the first substrate 40. Since the first substrate 40 has no pattern in the radially inside of the primary coil 41, or a portion in which the core of the transformer is accommodated, no eddy current flows when current flows in the primary coil 41. Since the secondary coil 51 and the radiator plate 52 are insulated by the insulating sheet, no eddy current flows when current flows in the secondary coil 51.

In hybrid vehicles, there has been a demand for an increase of travel distance by a traction motor by increasing battery capacity for improvement of fuel consumption and reduction of exhaust gas emission. An increase of electrical driving energy is required for increasing the output power of a traction motor. For increasing the electrical current, a copper wire with an increased diameter may be used for the motor only with a sacrifice of compactness in size of the motor. In contrast to using a thick wire, increasing the battery voltage makes possible boosting the output power of the motor while suppressing an increase in the size of the motor. Therefore, high voltage of the battery is preferable. When a battery with a high output voltage is used, the number of turns of the primary coil 41 of the transformer 11 needs to be increased to step down the battery voltage to a secondary voltage that is suitable for driving auxiliary equipment o the vehicle. However, the primary coil 41 is formed by winding a plurality of times a conductive wire covered with an insulate layer, so that space factor is larger and an increase of the size of the primary coil 41 is suppressed.

The induction device according to the above-described embodiment offers the following advantageous effects.

(1) The transformer 11 as an induction device includes the first coil (or the primary coil 41) that is formed by winding a plurality of times a conductive wire that is covered with an insulating layer 41C, the second coil (or the secondary coil 51) that is formed of a metal pattern, and the coil support 60 that is provided between the first coil and the second coil. The first coil and the second coil are magnetically connected to each other. In the first coil in which a conductive wire that is covered with an insulating layer 41C is spirally wound a plurality of times with any two turns of the conductive wire kept in contact with each other in radial direction, the conductive wire is insulated successfully, as compared to a case that the first coil is formed of a metal pattern. That is, space factor of the primary coil 41 is larger. Therefore, the number of turns of the first coil can be increased without enlargement in size, as compared to the case that the first coil that is wound in the same number of turns and formed of a metal pattern.

(2) The coil support 60 is formed of an insulating substrate and at least the first coil of the first and the second coils is supported by the insulating substrate. Thus, the winding start 41A and the winding end 41B of the first coil (or the primary coil 41) can be connected easily to the insulating substrate.

(3) The electrical connection between the winding start 41A of the primary coil 41 and the substrate pattern 46 that is formed at a position on the face side of the first substrate 40 that is opposite from the side on which the primary coil 41 is formed is accomplished by the solder 44 in the hole 45 that is formed through the first substrate 40. Therefore, the primary coil 41 that is made of an enameled wire and through which low voltage current flows can be connected to the substrate pattern 46 that is disposed outside the primary coil 41 while the enameled wire is spirally wound without any intersection. Furthermore, the transformer 11 may dispense with parts such as a connector and a terminal for connecting the primary switching element (corresponding to the primary switching element 13 in FIG. 1) to the primary coil 41. Therefore, the reduced number of parts helps to reduce the cost of the induction device.

(4) The first coil (or the primary coil 41) is fixed to the first insulating substrate (or the first substrate 40) and the second coil (or the secondary coil 51) is fixed to the second insulating substrate (or the second substrate 50), respectively. The radiator plate 52 that can be fixed to the radiator member (or the aluminum case 30) is fixed to the second insulating substrate on the side thereof that is opposite to the side on which the second coil of the second insulating substrate is mounted. The first coil and the second coil are disposed on opposite sides of the first insulating substrate. The first coil, the second coil, and the radiator plate 52 are disposed in an overlapping relation to each other in their thickness direction. According to the above-described configuration, the heat of the coils is radiated through the radiator plate 52.

(5) The aluminum case 30 serves as a radiator member and a grounding member and the radiator plate 52 is connected to the aluminum case 30. According to the configuration, the heat of the coils is radiated efficiently.

(6) The assembling of the transformer 11 is performed easily in that, first, the first substrate 40, the second substrate 50, and the radiator plate 52 are fixed to the aluminum case 30 by the screw 56 and then, the upper core 61 and the lower core 62 are fixed to the aluminum case 30 through the metal pressing plate 58 by the screw 56.

(7) The primary coil 41 and the secondary coil 51 are not only connected at the ends thereof to the first substrate 40 and the second substrate 50 by the solder 44, respectively, but also fixed at a portion thereof to the first substrate 40 and the second substrate 50 by adhesive, respectively. Therefore, the durability of the coils against vibration is enhanced as compared to a case in which the primary coil 41 and the secondary coil 51 are connected to the first substrate 40 and the second substrate 50, respectively, only by soldering.

(8) The transformer 11 is used for the insulated DC-DC converter 10 that steps down the voltage of a battery for a traction motor of a vehicle to a voltage for auxiliary equipment. It is preferable that parts for a vehicle should be small. In a case that a battery having a higher output voltage is used for increasing the battery capacity, a high space factor of the primary coil 41 can suppress enlargement of the transformer 11.

(9) The first coil (or the primary coil 41) is formed by winding a plurality of times a conductive wire that is covered with an insulating layer 41C. Unlike the case in which the coil is made by pressing or etching, the present embodiment allows a transformer to be used with a battery having a different output voltage by changing the number of turns of the coil. Specifically, in a case that coil is made by pressing or etching, a specific die or resist mask need be prepared for each different coil. According to the present embodiment, however, the same jig may be used for coils with different numbers of turns.

The present invention is not limited to the above-described embodiments, but it may be modified or embodied variously within the scope of the invention as exemplified below. The first coil is not limited to a circle in sectional shape, but may be rectangular. The first coil is not limited to a DC-DC converter of a hybrid vehicle, but may be to a DC-DC converter of an electrical vehicle.

The transformer 11 may be used for an insulated power converter and may be applied to any other devices as well as to a DC-DC converter. The transformer 11 may be used as a step-up transformer, as well as a step-down transformer. In the case of using for an up-converter, the secondary coil that has a larger number of turns than the primary coil may be formed by winding a plurality of times a conductive wire covered with an insulating layer 41C and the primary coil is formed of a metal pattern.

The second coil is not limited to what is made by pressing a conductive plate, but may be formed by etching a conductive plate or etching a conductive layer formed on an insulating substrate.

The insulating resistance of the first substrate 40 may be adjusted by using an insulating substrate having a different thickness as the insulating substrates forming the first substrate 40. A spacer may be disposed between the first substrate 40 and the second substrate 50 for adjusting the flux leakage between the primary coil 41 and the secondary coil 51.

In the insulating substrate forming the first substrate 40, the insulating resistance and flux leakage may be adjusted by reducing the thickness of the insulating substrate at a portion thereof that faces the secondary coil 51. The enameled wire forming of the first coil may be electrically connected to a part to which a portion of the enameled wire is connected by soldering after the insulating film of the portion of the enameled wire is dissolved by the heat of melted solder for soldering. In this case, removing the insulating film of the portion of the enameled wire is not needed before soldering.

In the configuration in which the winding start 41A and the winding end 41B of the primary coil 41 are connected to the first substrate 40 through the solder 44 and the through holes 45, the winding start 41A and the winding end 41B may be folded and inserted into the holes 45 for connection to the first substrate 40 through the solder 44.

The conductive wire having insulation on the surface thereof is not limited to a wire covered with an insulating film such as an enameled wire, but may be a conductive wire having on the surface thereof an oxidized layer formed by heat treatment.

The primary switching element may use any other type of switching element other than MOSFET, such as IGBT. The primary coil 41 may be fixed to the first substrate 40 only at the winding start 41A and the winding end 41B thereof.

What is claimed is:

1. An induction device comprising:

a first coil formed by winding an insulated conductive wire a plurality of times, the conductive wire being covered with an insulating layer;

a second coil being a metallic sheet having a pattern; and a coil support member disposed between the first coil and the second coil, wherein the coil support member is a first insulating substrate, wherein the first coil is supported by the first insulating substrate, wherein a winding start and a winding end of the first coil are connected to the first insulating substrate, wherein the conductive wire forming the first coil is a single continuous wire, wherein the first coil and the second coil are magnetically connected to each other, wherein the first coil is supported by the first insulating substrate and the second coil is supported by a second insulating substrate, wherein a radiator plate, formed of a metal pattern, is supported on one side of the second insulating substrate that is opposite from the second coil and is fixed to a heat sink, and wherein the heat sink, an insulating sheet, the first coil, the first insulating substrate, the second coil, the second insulating substrate and the radiator plate are aligned in an axial direction of the first coil.

2. The induction device according to claim 1, wherein the first coil is disposed only on one side of the coil support member.

3. The induction device according to claim 1, wherein the first coil and the second coil are disposed on opposite sides of the coil support member.

4. The induction device according to claim 1, wherein the first coil, the second coil, and the coil support member are encased by a first core and a second core, and wherein the first core is larger than the second core.

5. The induction device according to claim 1, wherein the second coil is disposed between the first insulating substrate and a radiator plate.

6. A transformer comprising:

a primary coil formed by winding an insulated conductive wire a plurality of times, the conductive wire being covered with an insulating layer;

a secondary coil being a metallic sheet having a pattern; and a coil support member disposed between the primary coil and the secondary coil, wherein the coil support member is a first insulating substrate, wherein the primary coil is supported by the first insulating substrate, wherein a winding start and a winding end of the primary coil are connected to the first insulating substrate, wherein the conductive wire forming the primary coil is a single continuous wire, wherein the primary coil and the secondary coil are magnetically connected to each other, wherein the primary coil is supported by the first insulating substrate and the secondary coil is supported by a second insulating substrate, wherein a radiator plate, formed of a metal pattern, is supported on one side of the second insulating substrate that is opposite from the secondary coil and is fixed to a heat sink, and wherein the heat sink, an insulating sheet, the primary coil, the first insulating substrate, the secondary coil, the second insulating substrate and the radiator plate are aligned in an axial direction of the primary coil.

7. The transformer according to claim 6, wherein the primary coil is mounted on the first insulating substrate and the secondary coil is mounted on a second insulating substrate, wherein the primary coil is provided on one side of the first insulating substrate that is opposite from the second insulating substrate, wherein the secondary coil is provided on one side of the second insulating substrate that is opposite from the first insulating substrate and the primary coil and the secondary coil are disposed in overlapping relation to each other.

* * * * *